US008868313B2

(12) United States Patent
Asti

(10) Patent No.: US 8,868,313 B2
(45) **Date of Patent: *Oct. 21, 2014**

(54) METHOD FOR CONTROLLING THE PRESSURE DYNAMICS AND FOR ESTIMATING THE LIFE CYCLE OF THE COMBUSTION CHAMBER OF A GAS TURBINE

(75) Inventor: Antonio Asti, Padua (IT)

(73) Assignee: Nuovo Pignone S.p.A., Florence (IT)

( * ) Notice: Subject to any disclaimer, the term of this patent is extended or adjusted under 35 U.S.C. 154(b) by 1635 days.

This patent is subject to a terminal disclaimer.

(21) Appl. No.: 12/098,563

(22) Filed: Apr. 7, 2008

(65) Prior Publication Data

US 2008/0294322 A1 Nov. 27, 2008

(30) Foreign Application Priority Data

May 23, 2007 (IT) ..... MI2007A1048

(51) Int. Cl.

| | |
|---|---|
| ***G06F 19/00*** | (2011.01) |
| ***F23R 3/34*** | (2006.01) |
| ***F23N 3/00*** | (2006.01) |
| ***F23N 5/00*** | (2006.01) |
| *F23N 5/16* | (2006.01) |

(52) U.S. Cl.

CPC ..... *F23R 3/34* (2013.01); *F23N 2025/04* (2013.01); *F23N 5/16* (2013.01); *F23N 2041/20* (2013.01); *F23R 2900/00013* (2013.01); *F23R 2900/00005* (2013.01); *F23N 3/002* (2013.01); *F23N 5/00* (2013.01)

USPC ..... 701/100; 60/39.37; 60/715; 60/726; 60/772; 60/773; 134/22.12; 165/157; 323/205; 431/6; 702/42; 702/182; 705/7

(58) Field of Classification Search

USPC ..... 60/39.37, 715, 726, 772, 773; 134/22.12; 165/157; 323/205; 431/6; 702/42, 182; 705/7

See application file for complete search history.

(56) References Cited

U.S. PATENT DOCUMENTS

| | | | | |
|---|---|---|---|---|
| 6,082,092 | A * | 7/2000 | Vandervort | 60/773 |
| 2002/0178730 | A1 * | 12/2002 | Ganz et al. | 60/773 |
| 2003/0010014 | A1 * | 1/2003 | Bland et al. | 60/39.37 |
| 2003/0093242 | A1 * | 5/2003 | Olsson | 702/182 |
| 2004/0104017 | A1 * | 6/2004 | Franke et al. | 165/157 |

(Continued)

OTHER PUBLICATIONS

Definition of "ambient pressure" from McGraw Hill Dictionary of Scientific & Technical Terms, 1 page, 6th Edition, 2003.*

*Primary Examiner* — James Trammell
*Assistant Examiner* — Sanjeev Malhotra
(74) *Attorney, Agent, or Firm* — GE Global Patent Operation

(57) ABSTRACT

A method for controlling the combustion in a gas turbine including measuring, with one or more probes situated adjacent to the combustion chamber of the turbine, the amplitude of the pressure oscillations inside the combustion chamber and the persistence time or cycle of the same oscillations, evaluating the behavior under fatigue conditions of the combustion chamber, by constructing the Wohler curve for a certain material which forms the combustion chamber for a predefined combustion frequency and for the amplitude and cycle values of the pressure oscillations measured, measuring the cumulative damage to the combustion chamber during functioning under fatigue conditions of the turbine using the Palmgren-Miner hypothesis and exerting protection actions of the turbine if the cumulative damage value measured is exceeded.

4 Claims, 2 Drawing Sheets

(56) References Cited

U.S. PATENT DOCUMENTS

2004/0139749 A1* 7/2004 Reissig ..... 60/772
2005/0053876 A1* 3/2005 Joos et al. ..... 431/6
2005/0132706 A1* 6/2005 Fukutani et al. ..... 60/726
2005/0273277 A1* 12/2005 Ridnour et al. ..... 702/42
2006/0108988 A1* 5/2006 McKelvey et al. ..... 323/205
2006/0243308 A1* 11/2006 Asplund et al. ..... 134/22.12
2007/0214027 A1* 9/2007 Maeckel et al. ..... 705/7
2009/0019853 A1* 1/2009 Nilsson ..... 60/715

* cited by examiner 22
24
28
20
18
30
14
26
16
10
Air
12

Fig. 2
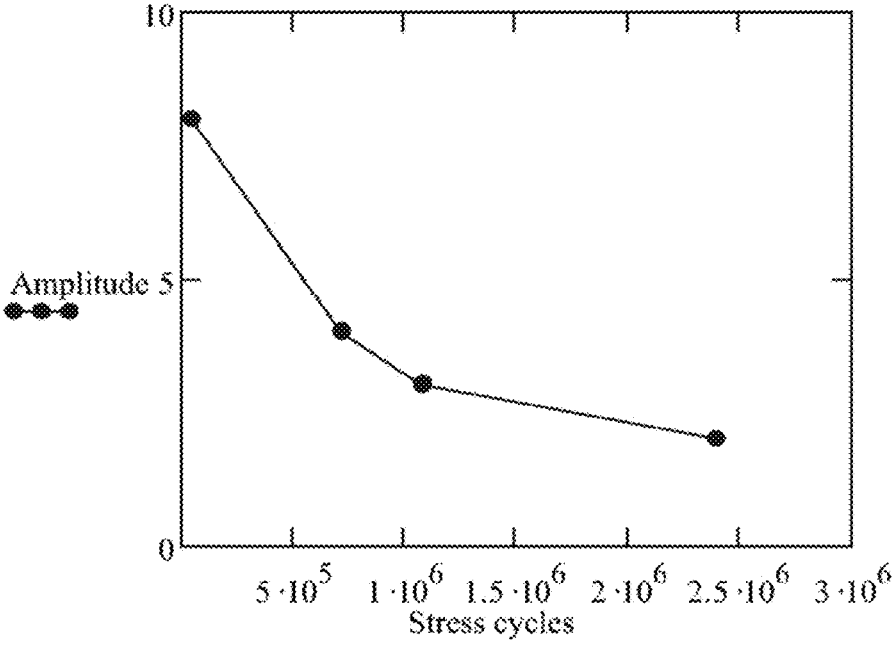
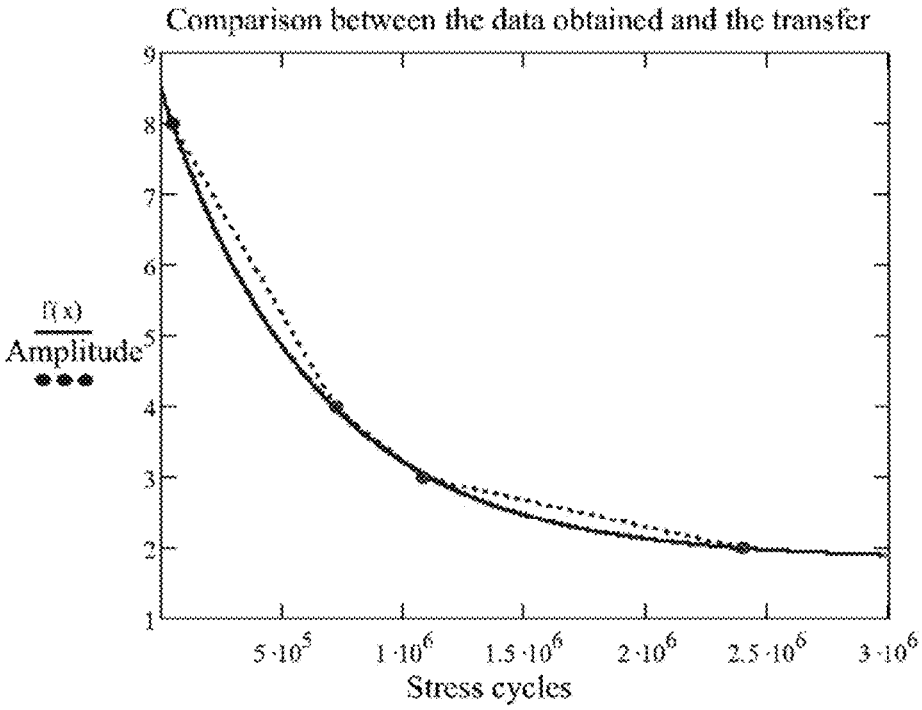
Fig. 3

METHOD FOR CONTROLLING THE PRESSURE DYNAMICS AND FOR ESTIMATING THE LIFE CYCLE OF THE COMBUSTION CHAMBER OF A GAS TURBINE

BACKGROUND OF THE INVENTION

1. Field of the Invention

The present invention relates to a method for controlling the pressure dynamics and estimating the life cycle of the combustion chamber of a gas turbine.

2. Description of the Related Art

The use of gas turbines, normally consisting of a multiphase compressor, in which the air sucked from the outside is compressed, a combustion chamber, in which the combustion takes place of gaseous fuel added to the compressed air, and a turbine or expander, in which the gases coming from the combustion chamber are expanded, is known for the production of electric energy. The turbine is then capable of generating mechanical energy which can be exploited for activating operating machines or for feeding electric generators.

Current methods for controlling the pressure dynamics of the combustion chamber of a gas turbine envisage that a certain protection action only be exerted after stress, having a specific level of amplitude, has been verified for a certain period of time. Furthermore, only a limited number of critical amplitudes is taken into consideration, whereas the periods of time are established on the basis of estimations based on experience.

The result obtained is that the action aimed at protecting the integrity of the combustion chamber and consequently of the turbine, is only exerted beyond a certain fatigue threshold, whereas the fatigue life cycle of the components of the turbine itself can also terminate below this threshold. As is known, fatigue is a mechanical phenomenon whereby a material subjected to varying loads with time, either regularly or casually, is damaged to breakage, even if the maximum intensity of the loads in question is much lower than that of breakage or static yield of the material itself.

An objective of the present invention is therefore to provide a method for controlling the pressure dynamics and for estimating the life cycle of the combustion chamber of a gas turbine, capable of establishing, on the basis of measurements of the pressure oscillations and using particular control and evaluation instruments, the admissible fatigue threshold for the same combustion chamber, allowing the due protection actions to be undertaken when excessive increases in pressure arise.

A further objective of the invention is to provide a method for controlling the pressure dynamics and for estimating the life cycle of the combustion chamber of a gas turbine, in which it is possible, on the basis of the data obtained, to optimize the maintenance intervals on the components of the combustion chamber itself.

BRIEF SUMMARY OF THE INVENTION

These objectives according to the present invention are achieved by providing a method for controlling the pressure dynamics and for estimating the life cycle of the combustion chamber of a gas turbine.

Further characteristics of the invention are indicated in the subsequent claims.

BRIEF DESCRIPTION OF THE DRAWINGS

The characteristics and advantages of a method for controlling the pressure dynamics and for estimating the life cycle of the combustion chamber of a gas turbine according to the present invention will appear more evident from the following illustrative and non-limiting description, referring to the enclosed schematic drawings in which:

FIG. 2 shows a diagram which relates a certain number of stress cycles measured with certain amplitude values; and FIG. 3 shows a comparison between the values of FIG. 2 and the function obtained by approximating these values by means of an exponential regression.

DETAILED DESCRIPTION OF THE PREFERRED EMBODIMENTS

Figure 1:
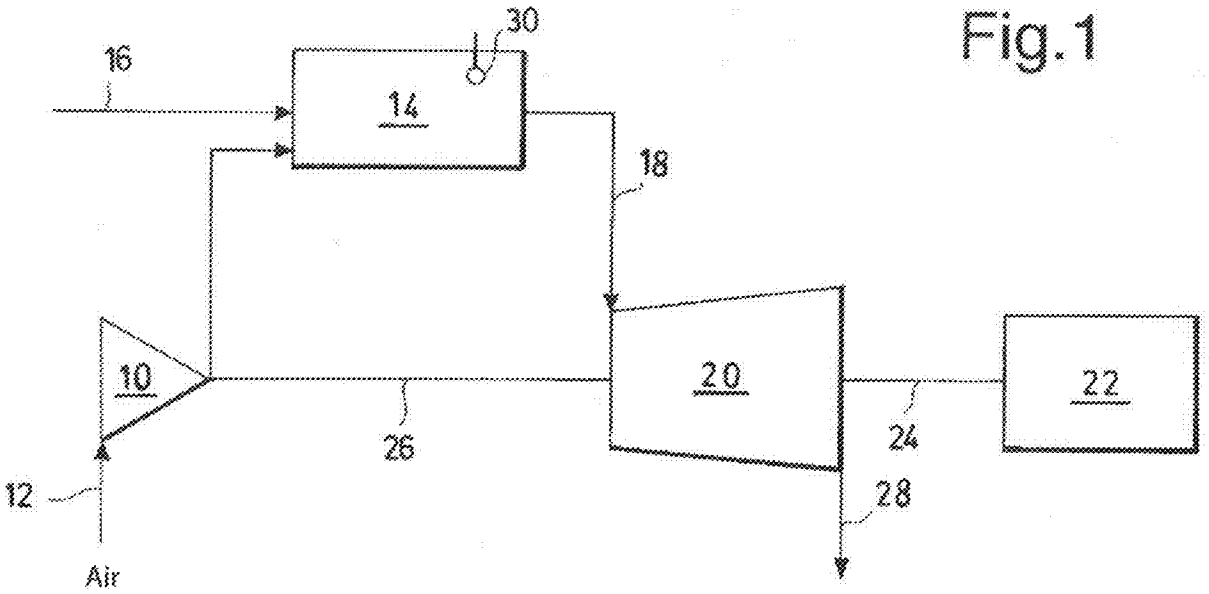
FIG. 1 is a schematic illustration of a gas turbine in which it is possible to apply a method for controlling the pressure dynamics and for estimating the life cycle of the combustion chamber according to the present invention.

With reference in particular to FIG. 1, this schematically shows a generic gas turbine, comprising a compressor 10 capable of compressing air introduced through an inlet duct 12. The compressed air is then sent to a combustion chamber 14 to be mixed with gaseous fuel coming from a supply duct 16. The combustion increases the temperature, the rate and volume of the gas flow and consequently of the energy contained therein. This gas flow is directed, through a duct 18, towards a turbine 20, which transforms the gas energy into work energy which can be exploited for activating operating machines, such as for example a generator 22 connected to the turbine 20 by means of a shaft 24. The turbine 20 also supplies the energy necessary for activating the compressor 10 through the relative shaft 26, whereas the exhaust gases are expelled by the turbine 20 through an outlet duct 28.

The method for controlling the pressure dynamics and for estimating the life cycle of the combustion chamber 14 according to the present invention envisages the correlation between the stress amplitudes, due to the increases in pressure which take place inside the combustion chamber 14 itself, and the persistence times (cycles) of said stress through the well-known Wohler curve.

The Wohler curve is a graph on a statistic basis which relates the maximum amplitude of a fatigue cycle with the number of cycles which a certain material tolerates before breakage with a pre-established probability. Its construction is effected by reconstructing a certain stress cycle in the laboratory with a certain amplitude which is applied to a high number of test-samples, registering the number of cycles they tolerate before breakage. Although the test-samples are subjected to the same stress, they do not all break after the same number of cycles but there is a dispersion of the results. Experience shows that this dispersion takes place according to a normal distribution. The same series of experiments is then repeated at different amplitude values and, for each distribution obtained, the average value of the number of cycles before breakage is registered.

The curve which joins all the average values at each stress amplitude is the Wohler curve at 50% probability of breakage. This means that, with respect to the samples tested, there is a 50% probability that, when subjected to a stress cycle of a certain amplitude, they will break before reaching the number of cycles delimited by the Wohler curve.

The method according to the invention then envisages a series of tests, using one or more probes 30 situated in correspondence with the combustion chamber 14, for the direct measurement in real time of the amplitude of the pressure oscillations inside the combustion chamber 14 itself. The measurements are used for determining the "cumulative stress", i.e. the amount of time which has lapsed over each significant amplitude level. The fatigue life cycle which has already passed is calculated by means of the well-known Palmgren-Miner hypothesis, considering all the amplitudes and relative consumptions of the fatigue life cycle.

When the cumulative damage D, defined below, exceeds a certain predefined value, a command is given to switch off the turbine and an inspection of the plant is effected. In this way, considering all the contributions of all the amplitudes of the fatigue cycles, a correct estimation of the residual fatigue life cycle can be obtained.

Operationally, according to an application example of the method according to the invention, the behaviour of the combustion chamber 14 is evaluated under fatigue conditions, by constructing the Wohler curve for a certain material which forms the combustion chamber 14 and for a combustion frequency of 400 Hz. Four points are identified for four different amplitude levels, from peak to peak, which allow a draft Wohler curve to be constructed (FIG. 2) on the basis of the following data:

| | | | | | |
|---|---|---|---|---|---|
| Duration | $10^2$ min | Amplitude | 2 | Cycles | $2.4 \times 10^6$ |
| | 45 min | | 3 | | $1.08 \times 10^6$ |
| | 30 min | | 4 | | $7.2 \times 10^5$ |
| | 2 min | | 8 | | $4.8 \times 10^4$ |

In order to measure the cumulative damage D to the combustion chamber 14 during functioning under fatigue conditions of the turbine, the Palmgren-Miner hypothesis is used, which asserts that the fraction of damage at any tension level is linearly proportional to the ratio between the number of functioning cycles and the total number of cycles which would produce the yield to that level of tension, i.e.:

$$D = \sum_{i=1}^{k} n_i / N_i$$

wherein the term D represents the cumulative damage, the term $N_i$ represents the residual life and derives from the Wohler curve and the term $n_i$ is measured. k indicates the number of amplitude levels, $N_i$ is the number of cycles necessary for reaching breakage at the i-th level of amplitude and $n_i$ is the number of cycles which have passed at the i-th level of amplitude.

The values indicated in FIG. 2 can be approximated with an exponential regression of the values of the cycles and amplitudes, as can be seen in the graph of FIG. 3, obtaining the following resulting function:

$$F(x):=6.651\cdot\exp(-1.583\cdot10^{-6}\cdot x)+1.839$$

In order to determine the values of $N_i$, it is necessary to calculate the inverse function, i.e.:

$$y=6.651\cdot\exp(1.583\cdot10^{6}\cdot x)+1.839\text{solve},x\rightarrow$$
$$(631711.93935565382186)$$
$$\cdot\ln(0.1503533303262667\,2681\cdot y-$$
$$0.276499774470004510 60)g(y):=$$
$$(631711.93935565382186)\cdot\ln$$
$$(0.1503533303262667 2681\cdot y-$$
$$0.276499774470004510\,60)$$

A vector is therefore created which represents the residual life, in terms of cycles, for the different amplitudes considered:

| | | | |
|---|---|---|---|
| Life = | g(2) | Life = | $2.351 \times 10^6$ |
| | g(3) | | $1.103 \times 10^6$ |

-continued

| | |
|---|---|
| g(4) | $7.102 \times 10^5$ |
| g(5) | $4.699 \times 10^5$ |
| g(6) | $2.963 \times 10^5$ |
| g(7) | $1.602 \times 10^5$ |
| g(8) | $4.834 \times 10^4$ |

The residual life of the combustor 14 is therefore represented by a vector containing the values of $N_i$ obtained by means of the Palmgren-Miner hypothesis. At this point, a meter measures the time which has passed between two consecutive amplitude levels i and i+1, for example equal to pressure values of 2 psi and 3 psi. The time interval measured is then attributed to the i-th of amplitude level and is multiplied by 400 Hz to obtain the value of $n_i$ at the (i+1)-th level. By dividing $n_i$ by $N_i$ and effecting the sum, the value of the cumulative damage D is finally obtained.

A threshold value equal to 0.1 is established for the cumulative damage D. When D exceeds this threshold value, the turbine is put under diffusion flame operational conditions, i.e. a type of functioning with lower pressure oscillation levels inside the combustion chamber 14 but with greater polluting emissions.

According to a preferred application example, the control software of the turbine is capable of directly using the continuous function g(y) for the calculation of the residual life, without the necessity of discretizing the residual life vector previously exposed.

It can thus be seen that the method for controlling the pressure dynamics and estimating the life cycle of the combustion chamber of a gas turbine according to the present invention achieves the objectives previously specified, as it allows a correct evaluation of the residual fatigue life of the combustion chamber to improve the performances of the turbine, allowing specific protection actions to be undertaken only when strictly necessary.

The method for controlling the pressure dynamics and estimating the life cycle of the combustion chamber of a gas turbine according to the present invention thus conceived can in any case undergo numerous modifications and variants, all included in the same inventive concept. The protection scope of the invention is therefore defined by the enclosed claims.

The invention claimed is:

1. A method for controlling the combustion in a gas turbine of the type comprising at least one compressor capable of compressing air introduced therein through an inlet duct, at least one combustion chamber, wherein said compressed air is mixed with a gaseous fuel coming from a supply duct, and wherein the gas turbine transforms energy of the gas coming from said combustion chamber into work energy, the method comprising:

measuring, with one or more probes situated adjacent to said combustion chamber, an amplitude of pressure oscillations inside the combustion chamber and a persistence time or cycle of the pressure oscillations;

evaluating a behavior under fatigue conditions of said combustion chamber by constructing a Wohler curve for a material which forms said combustion chamber, for a predefined combustion frequency and for said amplitude of pressure oscillations and cycle values of the measured pressure oscillations, wherein the Wohler curve is constructed using at least two pressure oscillation measurements from the probes adjacent to said combustion chamber during fatigue conditions;

measuring a cumulative damage to said combustion chamber during functioning under fatigue conditions of said gas turbine by means of a Palmgren-Miner hypothesis; said Palmgren-Miner hypothesis being defined as:

$$D = \sum_{i=1}^{k} n_i / N_i$$

wherein:

D=cumulative damage;

k=number of amplitude levels;

$N_i$=number of cycles necessary for reaching breakage at the i-th level of amplitude, deriving from said. Wohler curve;

$n_i$ is the a number of cycles which have passed at the i-th level of amplitude; and undertaking protective actions for said turbine when the cumulative damage value measured is exceeded.

2. The method according to claim 1, further comprising:

calculating, with an exponential regression function, said values of the cycles and amplitudes measured.

3. The method according to claim 2, further comprising:

calculating the inverse function of said exponential regression for determining said number of cycles.

4. The method according to claim 1, wherein said undertaking comprises putting said gas turbine under diffusion flame operational conditions and reducing the pressure oscillations inside said combustion chamber.

* * * * *